US006158709A

United States Patent [19]

Culp et al.

[11] Patent Number: 6,158,709

[45] **Date of Patent: *Dec. 12, 2000**

[54] MOUNTING APPARATUS FOR A PUMP PEDESTAL

[75] Inventors: Robert J. Culp, Parkland; Randy S. Morgan, Pipersville, both of Pa.

[73] Assignee: Milton Roy Company, Ivyland, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/275,280

[22] Filed: Mar. 24, 1999

[51] Int. Cl.[7] ..... F16M 11/00

[52] U.S. Cl. ..... 248/674

[58] Field of Search ..... 248/674, 676, 248/678, 672, 121, 312, 312.1, 313.2

[56] References Cited

U.S. PATENT DOCUMENTS

| | | | |
|---|---|---|---|
| Re. 35,425 | 1/1997 | Isom et al. | 74/6 |
| 2,513,735 | 7/1950 | Nardone | 248/604 X |
| 4,482,124 | 11/1984 | Dochterman | 248/604 |
| 4,601,378 | 7/1986 | Pierce et al. | 192/115 |
| 4,824,334 | 4/1989 | Ramsay | 417/360 |
| 5,211,294 | 5/1993 | Garman | 248/213.2 X |
| 5,306,121 | 4/1994 | Heflin et al. | 417/363 |
| 5,454,543 | 10/1995 | Carrico | 248/674 |
| 5,524,860 | 6/1996 | Ives | 248/674 |
| 5,647,732 | 7/1997 | Cali et al. | 417/360 |
| 5,705,870 | 1/1998 | Thomsen et al. | 248/604 X |

*Primary Examiner*—Ramon O Ramirez

[57] ABSTRACT

An apparatus is provided to mount a pedestal to a support. The support has first fastening elements different in number and position. The pedestal has a neck and a discharge port. The apparatus includes a flange, a mounting member, and a plurality of second fastening elements. The flange is formed around the neck. The mounting member has a channel which receives the flange. The plurality of second fastening elements cooperates with the mounting member and the first fastening elements of the support in order to clamp the flange between the mounting member and the support so as to secure the pedestal and discharge port at a desired orientation relative to the support. The support may comprise a motor and/or a mounting bracket, and the mounting member may comprise a swivel collar or a plurality of segments.

49 Claims, 4 Drawing Sheets

FIG.1
Prior Art
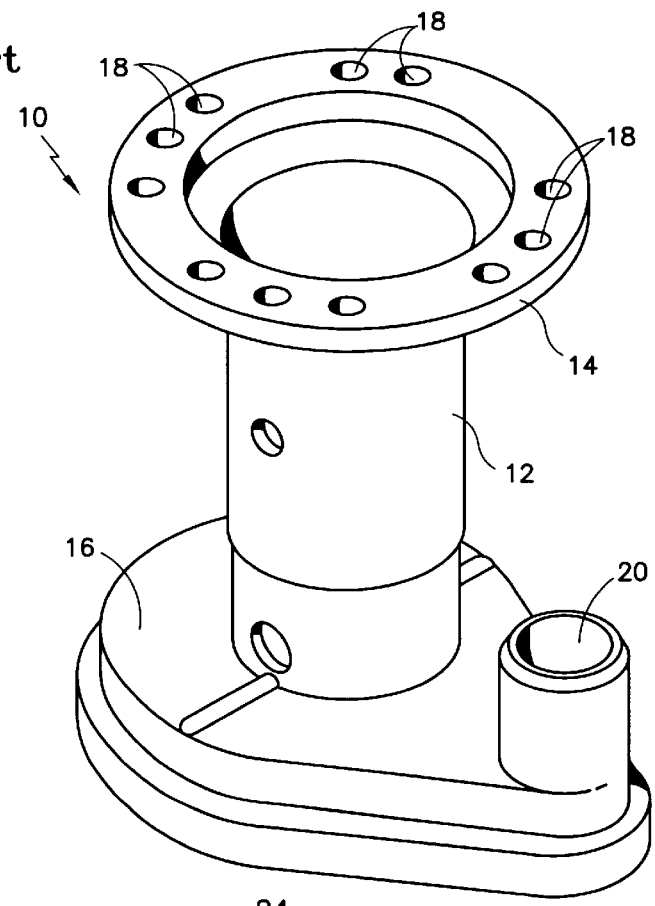
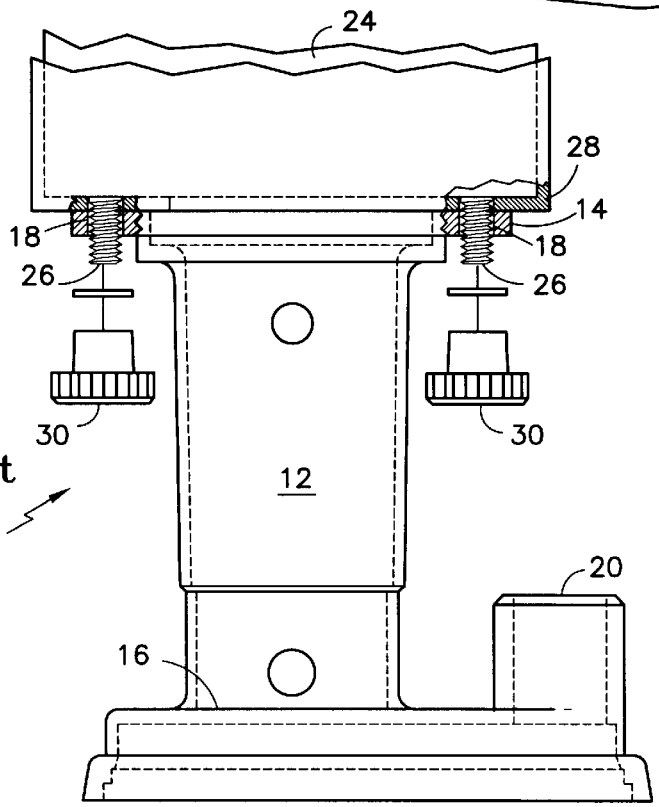
FIG.2
Prior Art

MOUNTING APPARATUS FOR A PUMP PEDESTAL

TECHNICAL FIELD

The present invention relates generally to a mounting arrangement for mounting a pedestal pump to a motor.

BACKGROUND ART

Pedestal pumps are used in a variety of applications. For example, pedestal pumps are used in ice machines to draw water in from a sump and to centrifugally force the water out through a discharge port over a heat exchanger which in turn cools the water in order to convert the water to ice. The pedestal pump typically has an impeller that is driven by a motor which is mounted to the pedestal so that an output shaft of the motor is directly coupled to the impeller through the pedestal.

The motor typically has threaded studs extending therefrom which are used to attach the motor to the pedestal. The threaded studs are passed through corresponding holes in a flange located at one end of the neck of the pedestal. Nuts are threaded over the threaded ends of the studs that protrude through the flange so as to attach the motor to the pedestal.

Because there are a variety of motors which could be used with the pedestal pump, there are a variety of stud configurations to which the flange at the neck of the pedestal must be adapted. Therefore, during attachment of the motor to the pedestal, the assembler currently forms holes through the flange to match the stud configuration of the selected motor. Moreover, not only must the hole configuration of the pedestal match the stud configuration of the motor, but the hole configuration of the pedestal must permit the pedestal and motor to be mounted to each other and to the housing of the ice machine so that the discharge port of the pedestal has the proper orientation.

As can be seen, the hole forming procedure as discussed above adds significantly to the labor cost associated with the assembling of pedestal mounted motors and pumps. Additionally, if the pedestal flange holes are pre-drilled, as is the case when pedestals are supplied to wholesalers and service organizations, then different pedestal models must be offered in order to accommodate the different motor stud configurations and orientation requirements for pedestal discharge ports.

The present invention is arranged to solve one or more of these problems by providing a mounting arrangement which greatly expands the number of motors which may be mounted to the pedestal, which increases the number of relative pedestal/motor positions in order to accommodate a wider variety of discharge port orientations, and which reduces the required number of pedestal models to one.

SUMMARY OF THE INVENTION

According to one aspect of the present invention, an apparatus mounts a pump pedestal to a support. The pump pedestal has a discharge port and a neck extending away from a base. The apparatus comprises a flange, a mounting member, a plurality of openings extending into the mounting member, and a plurality of fasteners, The flange is at an end of the neck remote from the base. The mounting member cooperates with the flange so that the mounting member permits the pedestal pump to be rotated with respect to the support in order to permit the pump pedestal to be mounted in a variety of angular positions with respect to the support. The plurality of fasteners extend into at least some of the openings to fasten the pedestal pump to the support in a selected one of the angular positions.

According to another aspect of the present invention, an apparatus mounts a selected one of first and second different motors to a pedestal. The first and second different motors each have first fastening elements different in number and position. The pedestal has a neck and a discharge port. The apparatus comprises a flange, a swivel collar, and a plurality of second fastening elements. The flange is formed around the neck. The swivel collar has a channel which receives the flange. The plurality of second fastening elements are arranged to accept the first fastening elements of either of the first and second motors, and cooperate with the swivel collar and the first fastening elements of the selected motor in order to clamp the flange between the swivel collar and the selected motor so as to secure the pedestal and discharge port in a desired orientation relative to the selected motor.

According to still another aspect of the present invention, an apparatus for mounting a pedestal in a variety of angular positions with respect to a motor comprises a pedestal, a mounting member, and a plurality of fastening elements. The pedestal has a neck and a discharge port. The mounting member cooperates with the neck so that the mounting member permits the pedestal to be rotated through multiple angles with respect to the support. The plurality of fastening elements are formed in the mounting member and are arranged to permit the pedestal to be fastened in a selected angular position with respect to the motor.

BRIEF DESCRIPTION OF THE DRAWINGS

These and other features and advantages of the present invention will become more apparent from a detailed consideration of the invention when taken in conjunction with the drawings in which:

FIG. 1 illustrates a prior art pump pedestal with holes drilled in a flange thereof for attaching the pump pedestal to a motor;

FIG. 2 illustrates a fastening arrangement for fastening the prior art pump pedestal of FIG. 1 to a motor;

DESCRIPTION OF THE PREFERRED EMBODIMENT

Figure 3:
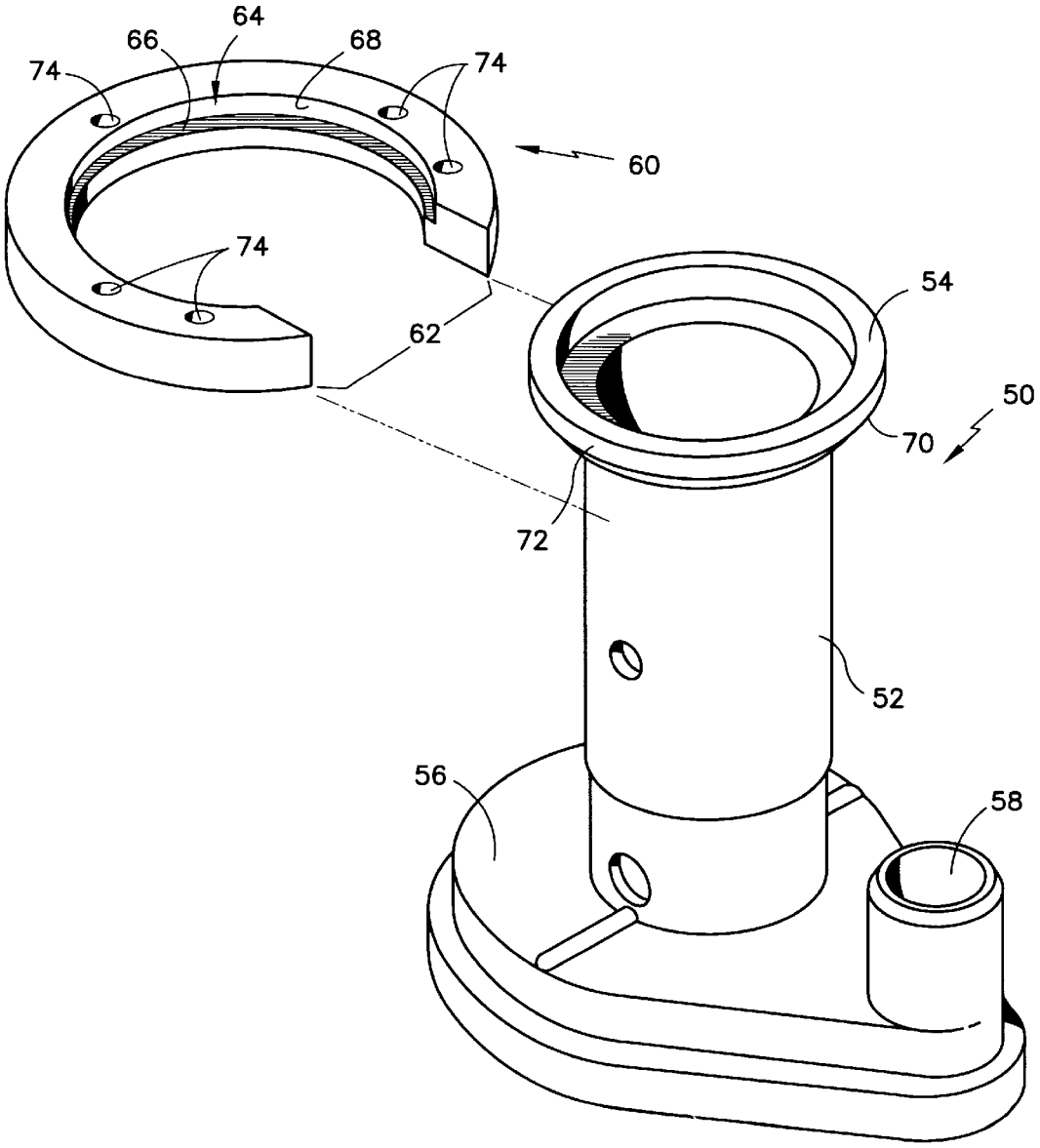
FIG. 3 illustrates a pump pedestal and a mounting member in the form of a swivel collar for attaching the pump pedestal to a motor in accordance with the present invention.

As shown in FIG. 1, a pump pedestal 10 according to the prior art includes a hollow neck 12 through which an output shaft of a motor extends when the pump pedestal 10 is fastened to the motor. At one end of the neck 12 is a flange 14, and at the other end of the neck 12 is an impeller housing 16.

The flange 14 has holes 18 drilled or bored therethrough for attaching the pump pedestal 10 to a motor, as will be explained below in connection with FIG. 2. The impeller housing 16 has a discharge port 20. When the motor to which the pump pedestal 10 is attached is energized, the output shaft of the motor drives a pump impeller housed in the impeller housing 16 in order to draw liquid into the impeller housing 16 and to force the liquid out through the discharge port 20.

The holes 18 are drilled or bored through the flange 14 during assembly in accordance with customer requirements. These customer requirements dictate (i) the number of, and separation between, the holes 18 in order to accommodate the configuration of the mounting studs of the motor to which the pump pedestal 10 is to be attached, and (ii) the angular position of the holes 18 around the flange 14 with respect to the discharge port 20 in order to assure proper orientation of the discharge port 20 within the appliance in which the pump pedestal 10 is used.

The fastening arrangement for the pump pedestal 10 is shown in FIG. 2. A motor 24 having threaded mounting studs 26 is positioned so that the threaded mounting studs 26 pass through holes in a mounting bracket 28 and through corresponding ones of the holes 18. Thumb nuts 30 (with corresponding washers as desired) are threaded over the threaded mounting studs 26 and are tightened in order to fasten the motor 24 and the pump pedestal 10 together with the mounting bracket 28 sandwiched therebetween. The mounting bracket 28 may be used to attach the motor 24 and the pump pedestal 10 to a housing or frame of an appliance.

During attachment of the motor 24 to the pump pedestal 10, the assembler drills or bores the holes 18 through the flange 14 to match the configuration of the threaded mounting studs 26 of the motor 24. Moreover, not only must the configuration of the holes 18 of the pump pedestal 10 match the configuration of the threaded mounting studs 26 of the motor 24, but the angular position of the holes 18 around the flange 14 must permit the pump pedestal 10 and the motor 24 to be mounted to the housing or frame of an appliance so that the discharge port 20 of the pump pedestal 10 has the proper orientation with respect to the appliance. This drilling or boring procedure adds significantly to the labor cost associated with assembling the motor 24 and the pump pedestal 10.

A pump pedestal 50 is disclosed in FIG. 3 which reduces this cost. The pump pedestal 50 according to the present invention includes a neck 52. The neck 52 may be hollow to accommodate an output shaft of a motor passing through the neck 52 from a motor to a pump impeller when the pump pedestal 50 is fastened to the motor. At one end of the neck 52 is a flange 54, and at the other end of the neck 52 is an impeller housing 56. The impeller housing 56 has a discharge port 58. When the motor to which the pump pedestal 50 is attached is energized, the output shaft of the motor drives a pump impeller housed in the impeller housing 56 in order to draw liquid into the impeller housing 56 and to force the liquid out through the discharge port 58.

A mounting member in the form of a swivel collar 60 is provided in order to fasten the pump pedestal 50 to a motor as explained below. The swivel collar 60 is C-shaped with an opening 62 through which the neck 52 passes when the swivel collar 60 is applied to the pump pedestal 50 during assembly. The swivel collar 60 has a channel 64 formed by a generally horizontal base channel surface 66 and an upstanding channel wall 68 rising therefrom.

Similarly, the flange 54 is formed by a base flange surface 70 and an upstanding flange wall 72 proximate to the base flange surface 70. Accordingly, when the pump pedestal 50 is to be attached to the motor, the swivel collar 60 is applied to the neck 52 so that the neck 52 passes through the opening 62 of the swivel collar 60. The flange 54 nests in the channel 64 so that the base flange surface 70 abuts the base channel surface 66 and the upstanding flange wall 72 resides within the upstanding channel wall 68.

The swivel collar 60 has holes 74 therethrough for fastening the pump pedestal 50 to a motor. The holes 74 are formed through the portion of the swivel collar 60 outside of the channel 64 and are provided in a configuration that accommodates a wide variety of motor mounting stud arrangements. Accordingly, the swivel collar 60 may be used to attach the pump pedestal 50 to a wide variety of motors. Also, the swivel collar 60 permits the pump pedestal 50 to be rotated with respect to a motor and/or mounting bracket in order to achieve proper alignment of the discharge port 58 with the appliance in which the pump pedestal 50 is used.

Figure 4:
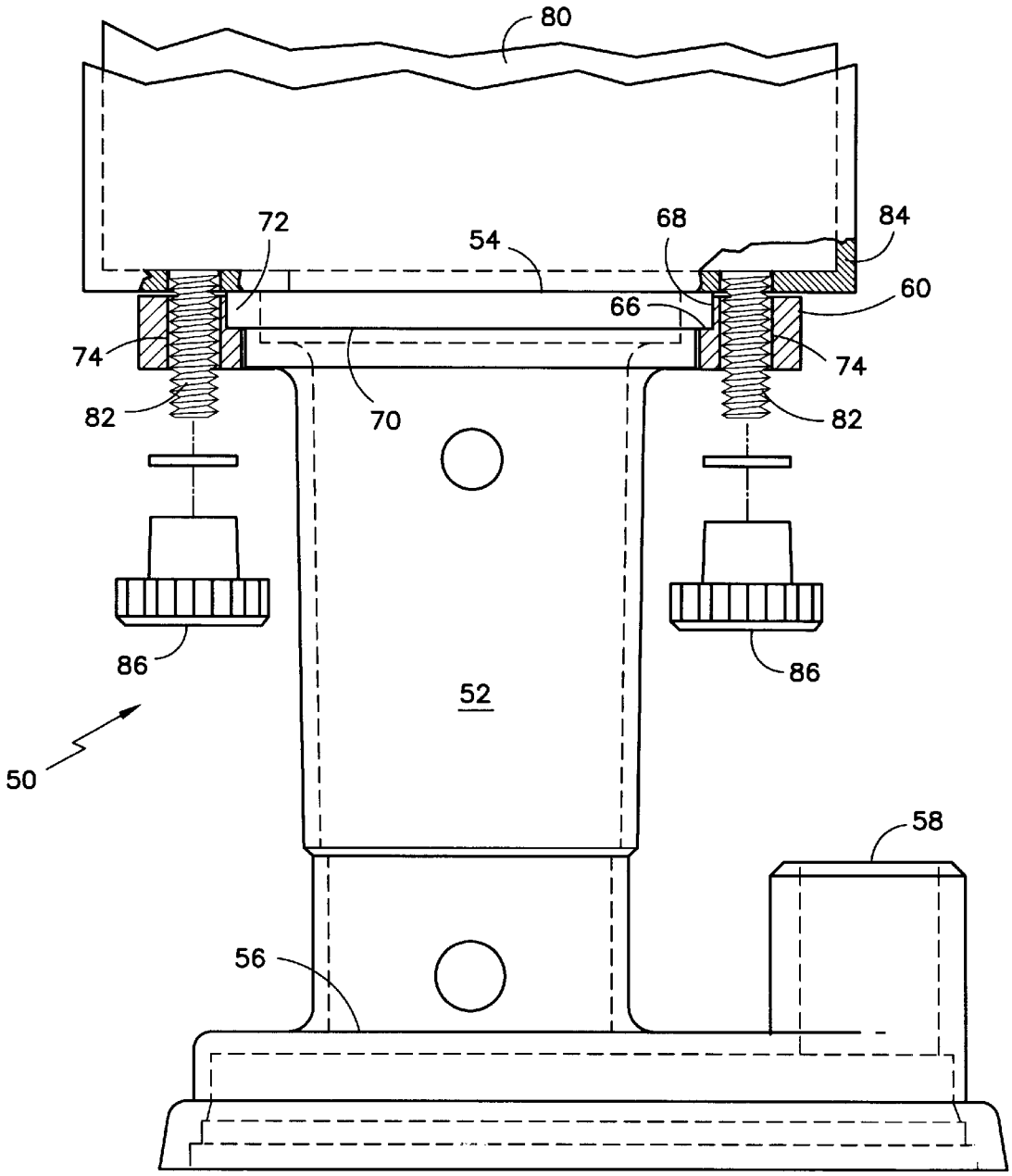
FIG. 4 illustrates a fastening arrangement for fastening the pump pedestal and swivel collar of FIG. 3 to a motor in accordance with the present invention; and, FIG. 5 shows a mounting member in the form of a plurality of segments for attaching the pump pedestal of FIGS. 3 and 4 to a motor in accordance with the present invention.

The fastening arrangement for the pump pedestal 50 is shown in FIG. 4. A motor 80 having threaded mounting studs 82 is positioned so that the threaded mounting studs 82 pass through corresponding holes in a mounting bracket 84 and through corresponding ones of the holes 74. Thumb nuts 86 (with corresponding washers as desired) are threaded over the threaded mounting studs 82 and are tightened in order to fasten the motor 80 and the pump pedestal 50 together with the mounting bracket 84 sandwiched therebetween. The mounting bracket 84 may be used to attach the motor 80 and pump pedestal 50 to a housing or frame of an appliance.

Figure 5:
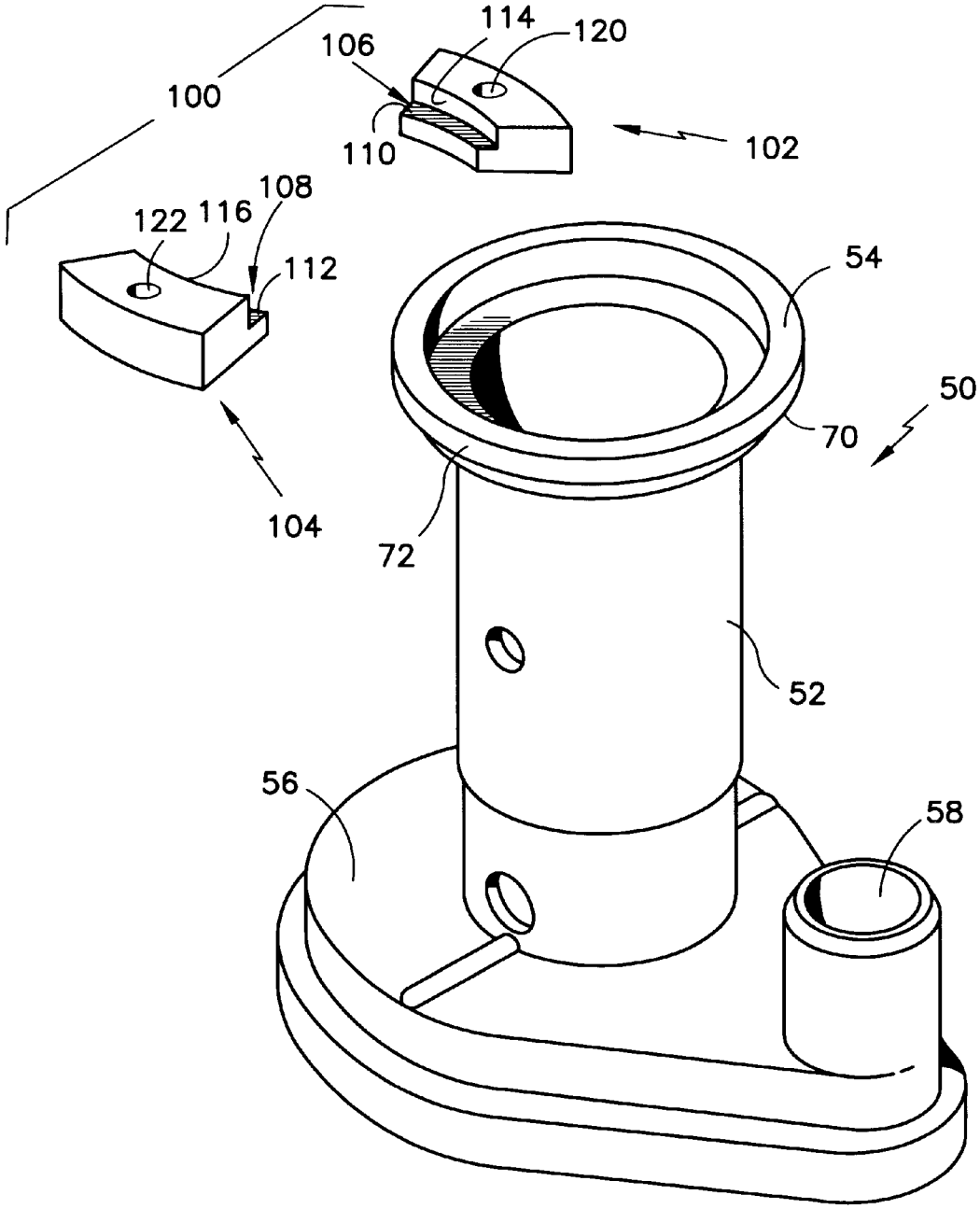

As shown in FIG. 5, a mounting member 100, instead of being a continuous swivel collar as shown in FIGS. 3 and 4, may be comprised of a plurality of segments 102 and 104. Although two such segments are shown in FIG. 5, it should be understood that the mounting member 100 may include three, four, five, or more such segments.

The segments 102 and 104 have corresponding channels 106 and 108 formed by corresponding generally horizontal base channel surfaces 110 and 112 and corresponding upstanding channel walls 114 and 116 rising therefrom. Accordingly, when the pump pedestal 50 is to be attached to the motor, the segment 102 is applied to the neck 52 so that a first stud of the motor 80 extends through a hole 120 of the segment 102 and so that the flange 54 nests in the channel 106. Thus, the base flange surface 70 abuts the base channel surface 110 and the upstanding flange wall 72 resides within the upstanding channel wall 114.

Similarly, the segment 104 is applied to the neck 52 so that a second stud of the motor 80 extends through a hole 122 of the segment 104 and so that the flange 54 nests in the channel 108. Thus, the base flange surface 70 abuts the base channel surface 112 and the upstanding flange wall 72 resides within the upstanding channel wall 116.

Accordingly, the mounting member 100 may be used to attach the pump pedestal 50 to a wide variety of motors. Also, the mounting member 100 permits the pump pedestal 50 to be rotated with respect to a motor and/or mounting bracket in order to achieve proper alignment of the discharge port 58 with the appliance in which the pump pedestal 50 is used.

Certain modifications of the present invention have been discussed above. Other modifications will occur to those practicing in the art of the present invention. For example, as described above, the motor 80 has threaded mounting studs 82 which protrude through the holes 74 of the swivel collar 60 and which threadably receive the thumb nuts 86 in order to fasten the motor 80 and the pump pedestal 50 together.

Alternatively, the motor 80 may have threaded holes which receive separate threaded studs which are threaded into the threaded holes of the motor 80, which protrude through the holes 74 of the swivel collar 60, and which threadably receive the thumb nuts 86 in order to fasten the motor 80 and the pump pedestal 50 together.

As a further alternative, the motor 80 may have threaded holes which threadably receive threaded bolts that are passed through the holes 74 of the swivel collar 60 and which are threaded into the threaded holes of the motor 80 until their heads abut the swivel collar 60 in order to fasten the motor 80 and the pump pedestal 50 together.

Moreover, as described above, the pump pedestal 50 is fastened directly to the motor 80 with the mounting bracket 84 sandwiched therebetween so that the motor 80 directly supports the pump pedestal 50, and the mounting bracket 84 directly supports the motor 80. However, the pump pedestal 50 may instead be fastened directly to the mounting bracket 84 so that the mounting bracket 84 directly supports the pump pedestal 50. In this case, the pump pedestal 50 is mounted by way of a first set of fasteners to the mounting bracket 84, and the motor 80 may be mounted by way of a second set of fasteners to the mounting bracket 84.

Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. An apparatus for mounting a pump pedestal to a support, wherein the pump pedestal has a discharge port and a neck extending away from a base, the neck having a flange remotely located from the base, wherein the apparatus comprises:

a mounting member adapted to cooperate with the flange so that the mounting member permits the pump pedestal to be rotated with respect to the support in order to permit the pump pedestal to be mounted in a variety of angular positions with respect to the support; and, a plurality of openings extending into the mounting member, wherein the plurality of openings are adapted to receive a plurality of fasteners extending into at least some of the openings to fasten the pump pedestal to the support in a selected one of the angular positions.

2. The apparatus of claim 1 wherein the mounting member is a swivel collar.

3. The apparatus of claim 2 wherein the swivel collar has a channel, wherein the channel is adapted to receive the flange, wherein the flange is clamped by the fasteners between the swivel collar and the support in order to secure the pump pedestal to the support in the selected angular position.

4. The apparatus of claim 3 wherein the channel is defined by a base channel surface and an upstanding collar wall proximate the base channel surface.

5. The apparatus of claim 4 wherein the base channel surface and the upstanding collar wall are arranged so that substantial lateral movement of the flange relative to the swivel collar is prevented.

6. The apparatus of claim 4 wherein the upstanding collar wall has a height substantially equal to a thickness of the flange whereby substantial up and down movement of the flange relative to the swivel collar is prevented.

7. The apparatus of claim 2 wherein the swivel collar has a channel, and wherein the channel is adapted to receive the flange, wherein the flange is clamped by the fasteners between the swivel collar and the support in order to secure the pump pedestal to the support in the selected angular position.

8. The apparatus of claim 2 wherein the swivel collar includes an opening having a width greater than a cross-sectional dimension of the neck.

9. The apparatus of claim 2 wherein the swivel collar comprises a C-shaped swivel collar.

10. The apparatus of claim 1 wherein the openings are adapted to cooperate with the fasteners so that the pump pedestal is permitted to be fastened to a variety of connector arrangements of the support.

11. The apparatus of claim 1 wherein the fasteners comprise threaded studs extending from the support and protruding into the openings, and wherein the fasteners further include thumb nuts threaded onto the threaded studs and engaging the mounting member.

12. The apparatus of claim 1 wherein the mounting member comprises at least first and second segments.

13. The apparatus of claim 12 wherein each of the first and second segments has a channel, wherein the channels of the first and second segments are adapted to receive the flange, and wherein the flange is clamped by the fasteners between the first and second segments and the support in order to secure the pump pedestal to the support in the selected angular position.

14. The apparatus of claim 13 wherein the channel of each of the first and second segments is defined by a base channel surface and an upstanding channel wall proximate the base channel surface.

15. The apparatus of claim 14 wherein the upstanding channel wall of the first segment, when the flange is clamped by the fasteners between the first segment and the support, wherein the base flange surface abuts the base channel surface of the second segment and the upstanding flange wall is within the upstanding channel wall of the second segment when the flange is clamped by the fasteners between the second segment and the support, and wherein the base flange surface,] the base channel surface of the first and second segments and the upstanding channel wall of the first and second segments are arranged so that substantial lateral movement of the flange relative to the first and second segments is prevented.

16. The apparatus of claim 14 wherein the upstanding channel wall of the first and second segments have a height substantially equal to a thickness of the flange whereby substantial up and down movement of the flange relative to the first and second segments is prevented.

17. The apparatus of claim 12 wherein the first and second segments each has a channel, wherein the channels of the first and second segments are adapted to receive the flange, and wherein the flange is clamped by the fasteners between the first and second segments and support in order to secure the pump pedestal to the support in the selected angular position.

18. The apparatus of claim 1 wherein the support is a motor.

19. The apparatus of claim 18 wherein the support includes a mounting bracket sandwiched between the motor and the mounting member.

20. The apparatus of claim 1 wherein the support is a mounting bracket.

21. An apparatus for mounting a selected one of first and second different motors to a pedestal, wherein the first and second different motors each have first fastening elements different in number and position, wherein the pedestal has a discharge port and a neck, the neck having a flange formed there around, and wherein the apparatus comprises:

a swivel collar having a channel adapted to receive the flange; and a plurality of second fastening elements being arranged to accept the first fastening elements of either of the first and second motors and cooperating with the swivel collar and the first fastening elements of the selected motor in order to clamp the flange between the swivel collar and the selected motor so as to secure the pedestal and discharge port in a desired orientation relative to the selected motor.

22. The apparatus of claim 21 wherein the second fastening elements comprise openings in the swivel collar outside of the channel, and wherein the openings are adapted to receive the first fastening elements in order to fasten the pedestal to the selected motor.

23. The apparatus of claim 21 wherein the channel is defined by a base channel surface and an upstanding collar wall proximate the base channel surface.

24. The apparatus of claim 23 wherein the base channel surface and the upstanding collar wall are arranged so that substantial lateral movement of the flange relative to the swivel collar is prevented.

25. The apparatus of claim 23 wherein the upstanding collar wall has a height substantially equal to a thickness of the flange whereby substantial up and down movement of the flange relative to the swivel collar is prevented.

26. The apparatus of claim 21 wherein the swivel collar includes an opening having a width greater than a cross-sectional dimension of the neck.

27. The apparatus of claim 21 wherein the swivel collar comprises a C-shaped swivel collar.

28. An apparatus for mounting a pedestal in a variety of angular positions with respect to a motor the pedestal having a neck and a discharge port whereas the neck having a flange thereon, the apparatus comprising:

a mounting member adapted to cooperate with the flange so that the mounting member permits the pedestal to be rotated through multiple angles with respect to the motor; and, a plurality of fastening elements formed in the mounting member and arranged to permit the pedestal to be fastened in a selected angular position with respect to the motor.

29. The apparatus of claim 28 wherein the pedestal is fastened to the motor.

30. The apparatus of claim 29 wherein the pedestal is fastened to the motor with a mounting bracket sandwiched between the motor and the mounting member.

31. The apparatus of claim 28 wherein the pedestal is fastened to a mounting bracket.

32. The apparatus of claim 28 wherein the mounting member is adapted to clamp the flange between the support and the mounting member when the pedestal is fastened to the support.

33. The apparatus of claim 28 wherein the fastening elements are openings extending into the mounting member.

34. The apparatus of claim 28 wherein the fastening elements are fasteners extending from the mounting member.

35. The apparatus of claim 28 wherein the fastening elements comprise openings in the mounting member and fasteners extending into the openings and holes of a support to fasten the pedestal to the support.

36. The apparatus of claim 35 wherein the fastening elements comprise nuts cooperating with the fasteners to fasten the pedestal to the support.

37. The apparatus of claim 28 wherein the fastening elements comprise openings in the mounting member, and wherein fasteners of a support protrude into the openings to fasten the pedestal to the support.

38. The apparatus of claim 28 wherein the mounting member comprises a C-shaped swivel collar.

39. The apparatus of claim 28 wherein the fastening elements comprise openings into the mounting member and fasteners extending into the openings in the mounting member and into holes of a support in order to fasten the pedestal to the support.

40. The apparatus of claim 28 wherein the mounting member cooperates with the flange so that the mounting member permits the pedestal to be rotated through at least 60°.

41. The apparatus of claim 28 wherein the mounting member has a channel, wherein the channel is adapted to receive the flange, wherein the channel is defined by a base channel surface and an upstanding channel wall proximate to the base channel surface.

42. The apparatus of claim 41 wherein the base channel surface and the upstanding channel wall are arranged so that substantial lateral movement of the flange relative to the mounting member is prevented.

43. The apparatus of claim 41 wherein the upstanding channel wall has a height substantially equal to a thickness of the flange whereby substantial up and down movement of the flange relative to the mounting member is prevented.

44. The apparatus of claim 28 wherein the mounting member comprises at least first and second segments.

45. The apparatus of claim 44 wherein each of the first and second segments has a channel, wherein the channels of the first and second segments are adapted to receive the flange in order to secure the pedestal to the support in the selected angular position.

46. The apparatus of claim 45 wherein the channel of each of the first and second segments is defined by a base channel surface and an upstanding channel wall proximate the base channel surface.

47. The apparatus of claim 46 wherein the base channel surface of the first and second segments, and the upstanding channel wall of the first and second segments are arranged so that substantial lateral movement of the flange relative to the first and second segments is prevented.

48. The apparatus of claim 46 wherein the upstanding channel wall of the first and second segments has a height substantially equal to a thickness of the flange whereby substantial up and down movement of the flange relative to the first and second segments is prevented.

49. The apparatus of claim 44 wherein the first and second segments each has a channel, wherein the channels of the first and second segments are adapted to receive the flange, and wherein the flange is clamped by the fasteners between the first and second segments and the support in order to secure the pedestal to the support in the selected angular position.

* * * * *